US011487248B2

(12) United States Patent
Tamura

(10) Patent No.: US 11,487,248 B2
(45) Date of Patent: Nov. 1, 2022

(54) MOVEMENT AND TIMEPIECE

(71) Applicant: SEIKO EPSON CORPORATION, Tokyo (JP)

(72) Inventor: Shuichi Tamura, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 946 days.

(21) Appl. No.: 16/263,045

(22) Filed: Jan. 31, 2019

(65) Prior Publication Data

US 2019/0235443 A1 Aug. 1, 2019

(30) Foreign Application Priority Data

Feb. 1, 2018 (JP) ..... JP2018-016812

(51) Int. Cl.
*G04C 10/02* (2006.01)
*G04B 19/14* (2006.01)

(52) U.S. Cl.
CPC ..... *G04C 10/02* (2013.01); *G04B 19/14* (2013.01)

(58) Field of Classification Search
CPC ..... G04C 10/02
See application file for complete search history.

(56) References Cited

U.S. PATENT DOCUMENTS 6,518,493 B1 * 2/2003 Murakami ..... G04C 10/02 136/251
6,538,959 B1 * 3/2003 Yamaguchi ..... G04C 10/02 136/251
7,400,556 B2 * 7/2008 Osa ..... G04C 10/02 368/204
2005/0195689 A1 * 9/2005 Oguchi ..... H01Q 7/08 368/47
2006/0050618 A1 * 3/2006 Osa ..... G04C 10/02 368/205
2006/0153011 A1 * 7/2006 Osa ..... G04C 10/02 368/205
2014/0232603 A1 * 8/2014 Fujisawa ..... G04R 60/12 343/702
2015/0168922 A1 * 6/2015 Wanikawa ..... H01L 31/0508 136/244
2015/0378313 A1 * 12/2015 Abe ..... G04C 10/02 368/205
2016/0070238 A1 * 3/2016 Dubois ..... G04G 17/045 368/84
2016/0161921 A1 * 6/2016 Masaki ..... G04R 60/12 368/232
2017/0023915 A1 * 1/2017 Sawada ..... G04C 10/02
2017/0038743 A1 * 2/2017 Sawada ..... G04R 60/10

FOREIGN PATENT DOCUMENTS

JP H10-239453 A 9/1998
JP 2005-098711 A 4/2005
JP 2009-002767 A 1/2009
JP 2013-108904 A 6/2013
JP 2013-120111 A 6/2013

* cited by examiner

*Primary Examiner* — Edwin A. Leon
*Assistant Examiner* — Jason M Collins
(74) *Attorney, Agent, or Firm* — Oliff PLC

(57) ABSTRACT

A movement includes a solar panel that has a substrate made of resin, and a support member that is made of resin, has a frame shape, and supports the substrate through bonding through a bonding layer.

9 Claims, 4 Drawing Sheets

MOVEMENT AND TIMEPIECE

BACKGROUND

1. Technical Field

The present invention relates to a movement and a timepiece.

2. Related Art

A solar panel-equipped electronic timepiece has been known in which power generation energy generated by a solar panel is stored in a secondary battery and drives the electronic timepiece (for example, JP-A-2013-108904). The solar panel-equipped timepiece includes a movement, a solar panel provided on the movement, a dial receiving ring that supports the solar panel, a dial plate provided on the dial receiving ring, and a housing that houses them.

Further, in JP-A-2013-108904, the dial receiving ring has a hook portion protruding from an upper surface thereof, and the solar panel is supported by the dial receiving ring through engagement of the hook portion and an edge portion of the solar panel.

However, in a solar panel-equipped electronic timepiece disclosed in JP-A-2013-108904, since a hook portion is provided to protrude from an upper surface of a dial receiving ring, the thickness (a maximum thickness) of the dial receiving ring increases accordingly. As a result, there is a problem in that the entire solar panel unit including the dial receiving ring and the solar panel becomes thicker.

SUMMARY

An advantage of some aspects of the invention is to solve at least a part of the problems described above, and the invention can be implemented as the following configurations.

A movement according to an aspect of the invention includes a solar panel that has a substrate made of resin and converts light energy into electric energy, a support member that is made of resin, has a frame shape, and supports the substrate through bonding through a bonding layer, a driving mechanism that is driven with the electric energy converted by the solar panel, and a main plate to which the driving mechanism is attached and the support member is fixed.

In the aspect of the invention, the substrate of the solar panel and the support member are fixed to each other through the bonding layer. Accordingly, since the above-described fixing unit such as a hook is omitted, in a state in which the solar panel and the support member are fixed to each other, the entire solar panel unit can be thinned.

In the movement of the aspect of the invention, it is preferable that the support member has a stepped portion, and the support member and the substrate are bonded to each other in the stepped portion.

With this configuration, as compared to a case where the substrate of the solar panel is bonded to the upper surface (a main surface) of the support member, the solar panel may be fixed while coming into a middle of the support member in the thickness direction. Thus, the thickness of the entire solar panel unit may be prevented from being thickened.

In the movement of the aspect of the invention, it is preferable that the bonding layer is an adhesive, and the stepped portion has a raised portion provided with the bonding layer and a relief portion which the adhesive enters.

With this configuration, an excess portion of the adhesive may be prevented from being unwillingly attached to the other portions.

In the movement of the aspect of the invention, it is preferable that the plurality of raised portions are provided in the stepped portion.

With this configuration, bonding strength between the solar panel and the support member may further increase, and a bonding state can be maintained stably.

In the movement of the aspect of the invention, it is preferable that the bonding layer is provided at an edge portion of the solar panel, in a plan view seen in a direction that is perpendicular to the solar panel.

With this configuration, bending of the edge portion of the solar panel may be prevented from occurring.

In the movement of the aspect of the invention, it is preferable that the solar panel has a plurality of solar cell pieces and connectors that connect the adjacent solar cells in series to each other, and the connectors are provided at positions that are different from a position of the bonding layer, in the plan view seen in the direction that is perpendicular to the solar panel.

With this configuration, when the solar panel and the support member are fixed to each other, the connectors may be prevented from being damaged.

In the movement of the aspect of the invention, it is preferable that the solar panel and the support member have positioning portions that position the solar panel and the support member.

With this configuration, when the solar panel and the support member are assembled, the assembling operation may be easily performed.

In the movement of the aspect of the invention, it is preferable that the positioning portions include a positioning hole provided in the solar panel and a positioning hole provided in the support member.

With this configuration, the solar panel and the support member may be positioned. When the solar panel and the support member are positioned, a guide pin may be provided in the support member, and the positioning hole of the solar panel and the guide pin may be engaged with each other. However, in the aspect of the invention, since the guide pin is not provided in the support member, the entire solar panel unit may be further thinned.

A timepiece according to another aspect of the invention includes the movement according to the aspect of the invention and a case that accommodates the movement.

With this configuration, the timepiece that exhibits the above-described effects of the invention is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a movement and a timepiece according to the invention will be described in detail based on an exemplary embodiment illustrated in the accompanying drawings.

First Embodiment

Figure 1:
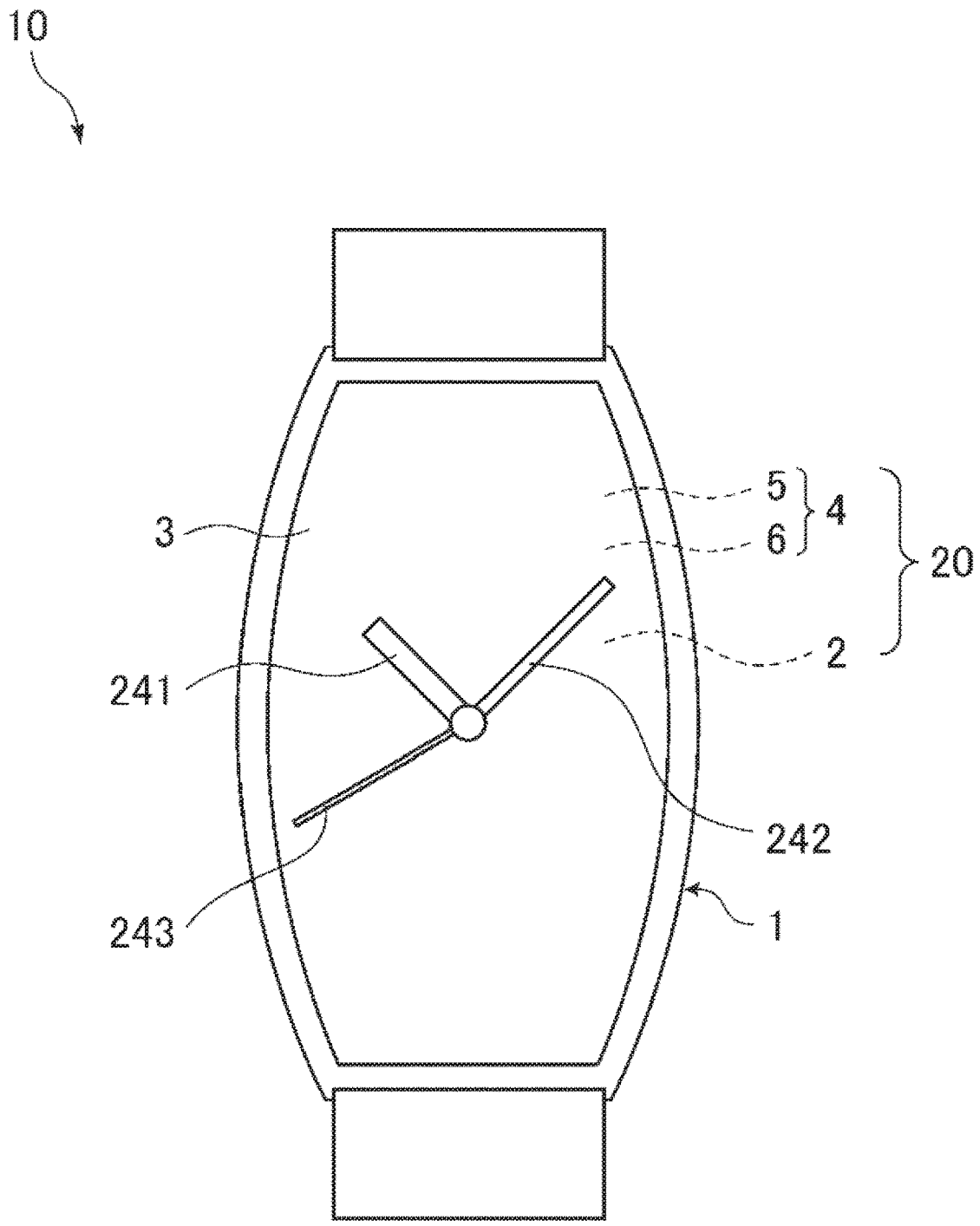
FIG. 1 is a plan view illustrating a timepiece (an electronic timepiece) including a solar panel unit according to a first embodiment.
Figure 2:
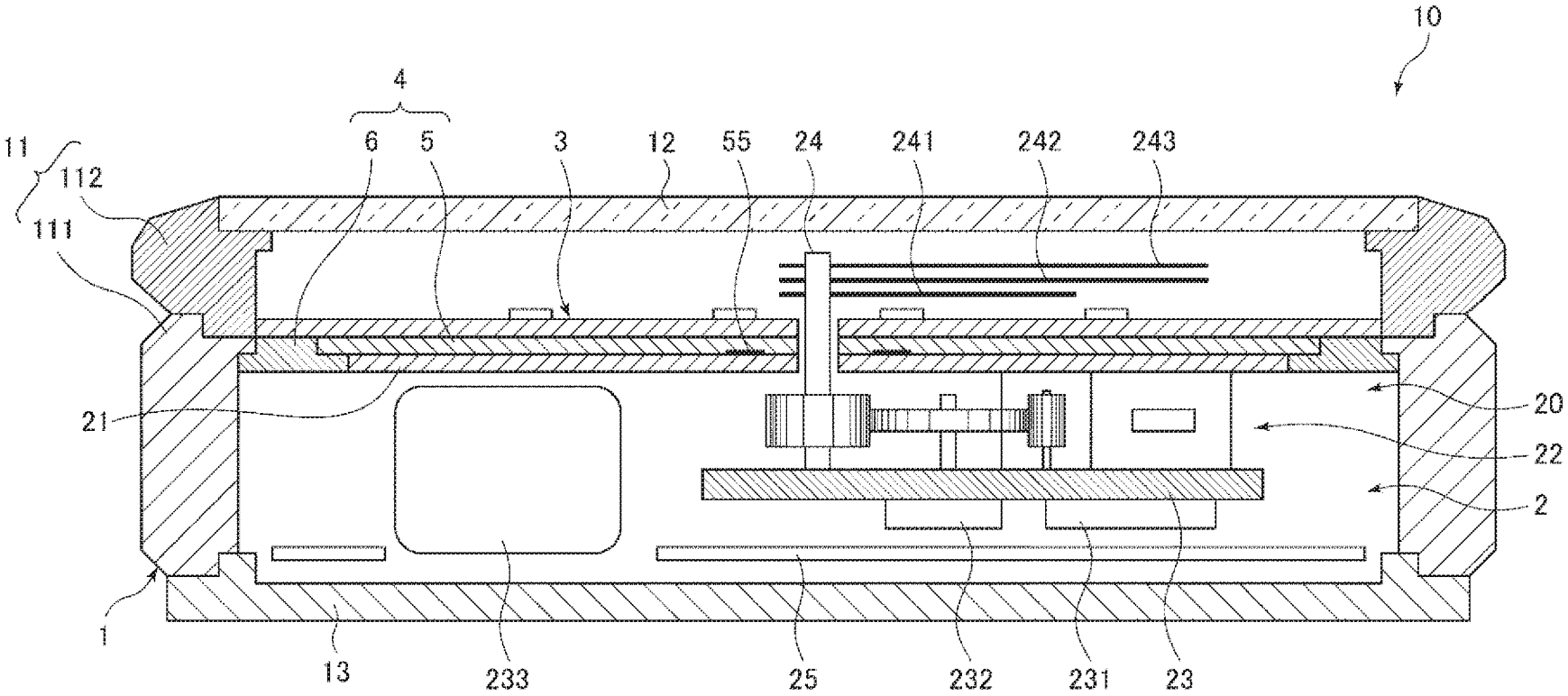
FIG. 2 is a sectional view illustrating the timepiece (the electronic timepiece) illustrated in FIG. 1.
Figure 3:
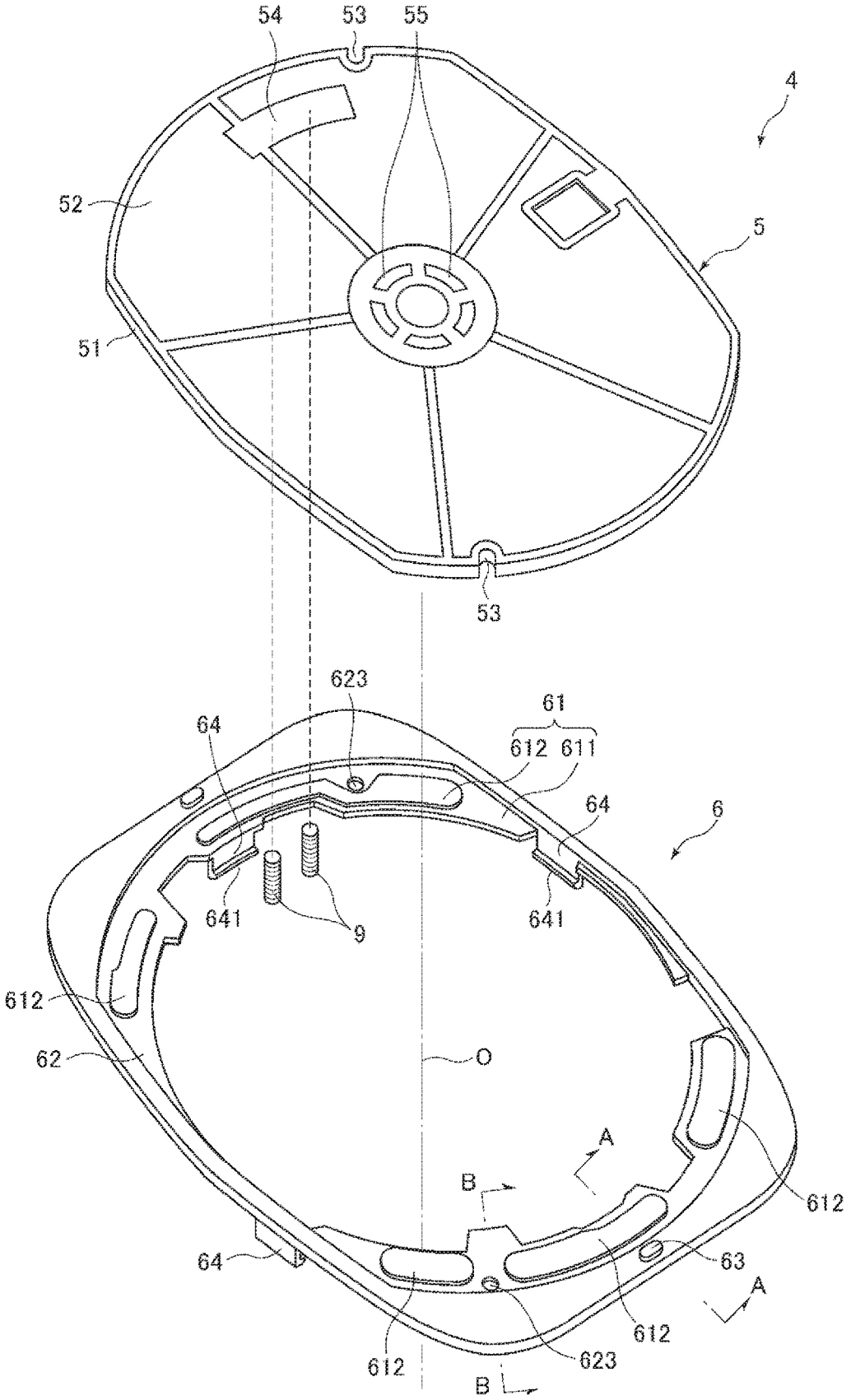
FIG. 3 is an exploded perspective view illustrating the solar panel unit included in the timepiece (the electronic timepiece) illustrated in FIG. 1.
Figure 4:
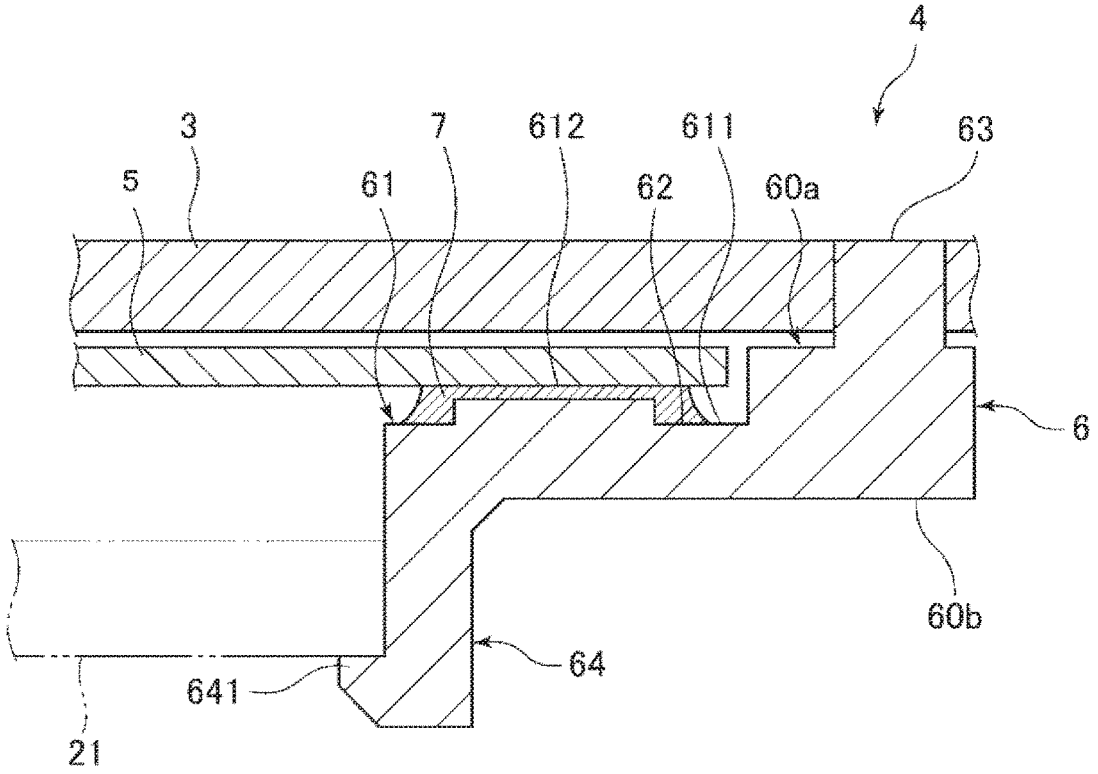
FIG. 4 is a sectional view taken along line A-A of FIG. 3.
Figure 5:
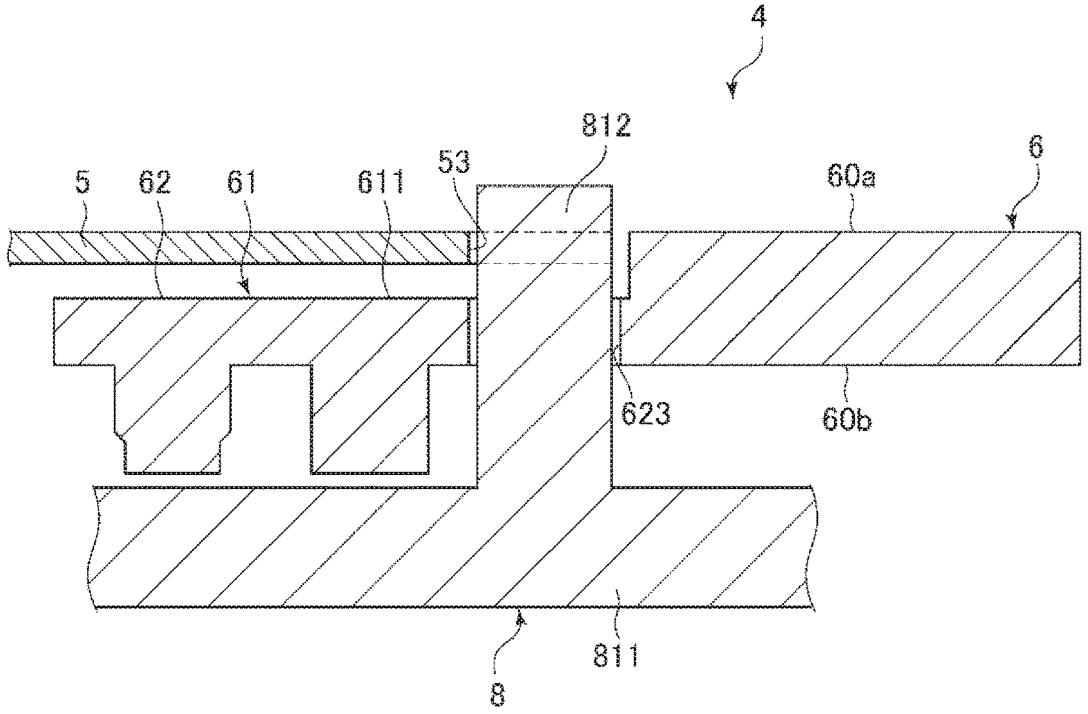
FIG. 5 is a sectional view taken along line B-B of FIG. 3.

FIG. 1 is a plan view illustrating a timepiece (an electronic timepiece) including a solar panel unit. FIG. 2 is a sectional view illustrating the timepiece illustrated in FIG. 1. FIG. 3 is an exploded perspective view illustrating the solar panel unit included in the timepiece illustrated in FIG. 1. FIG. 4 is a sectional view taken along line A-A of FIG. 3. FIG. 5 is a sectional view taken along line B-B of FIG. 3.

Hereafter, the solar panel unit, a solar panel-equipped movement, and the timepiece according to the present embodiment will be described with reference to FIGS. 1 to 5. Further, a side (a rear cover side) in contact with an arm of an electronic timepiece is called "down", "lower side", or "rear", and a side opposite thereto is called "up", "upper side", or "front".

As illustrated in FIGS. 1 to 3, the solar panel unit 4 includes a solar panel 5 having a substrate 51 made of resin, and a support member 6 made of resin, having a frame shape, and supporting the solar panel 5. The substrate 51 and the support member 6 are bonded to each other through an adhesive layer 7 (a bonding layer).

In the past, a solar panel and a support member were fixed to each other through a fixing unit such as a hook provided in the support member. In this configuration, the thickness of the entire support member increased depending on the thickness of the fixing unit itself. Further, in this configuration, in order to increase a fixing strength between the solar panel and the support member, the size of the fixing unit can be increased (thickened) or the number of installation positions of the fixing unit can be increased. However, in this case, the thickness of the entire support member tends to be further increased. In contrast, in the present embodiment, the above-described fixing unit is omitted, and the solar panel and the support member are fixed to each other through the bonding layer. Accordingly, since the above-described fixing unit such as a hook is omitted, the entire solar panel unit 4 can be thinned. Further, since the substrate of the solar panel and the support member are made of resin, for example, when an adhesive is used as the bonding layer, a bonding strength can be increased.

Further, as illustrated in FIGS. 1 to 2, a solar panel-equipped movement 20 includes the solar panel unit 4.

Accordingly, the solar panel-equipped movement that exhibits the above-described effects is obtained.

Further, as illustrated in FIGS. 1 to 2, an electronic timepiece 10 (a timepiece) includes the solar panel-equipped movement 20 and a housing 1 (a case) that houses the solar panel-equipped movement 20.

Accordingly, the solar panel-equipped movement that exhibits the above-described effects is obtained.

The electronic timepiece 10 is an antenna-embedded electronic timepiece. Further, the electronic timepiece 10 is a timepiece that receives a longwave standard radio wave as a radio wave including time information, and corrects positions indicated by an hour hand, a minute hand, and a second hand, based on the received time information.

Next, each unit of the electronic timepiece 10 will be described.

As illustrated in FIG. 2, the electronic timepiece 10 includes the housing 1, a movement 2, a dial 3, and a solar panel unit 4. Further, a pair of belts can be provided in an outer periphery of the housing 1, and can be attached to the arm.

The housing 1 includes an external case 11, a cover glass 12, and a rear cover 13. In the external case 11, for example, a bezel 112 made of ceramic is fitted in a cylindrical case 111 made of metal. The dial 3 is disposed on an inner periphery of the bezel 112 as a time displaying portion.

The movement 2 includes a main plate 21, a driving mechanism. 22 supported on the main plate 21, a printed circuit board 23, and a not-illustrated antenna.

The main plate 21 functions to support the driving mechanism 22, and the like. The main plate 21 is made of, for example, hard resin, and is attached to the support member 6, which will be described below.

The driving mechanism 22 is attached to a lower surface of the main plate 21. The driving mechanism 22 has a stepping motor and a gear train such as a gear, and the stepping motor rotates a pointer spindle 24 through the gear train so that pointers 241, 242, and 243 are driven. In this way, the driving mechanism 22 is covered from a rear surface side in the printed circuit board 23.

The printed circuit board 23 includes a controller 232 and a secondary battery 233 such as a lithium-ion battery. The secondary battery 233 is charged with electric power generated by the solar panel 5, which will be described below. The antenna includes an antenna core and a coil wound on the antenna core. Further, the printed circuit board 23 is pressed by a circuit presser 25 from a rear side thereof.

The solar panel-equipped movement 20 is configured with such a movement 2 and the solar panel unit 4 which will be described below.

The dial 3 has a time displaying portion, a calendar window, and the like, and the pointer spindle 24 passes through a central portion of the dial 3. Further, the dial 3 is made of, for example, a material having light transparency, such as a transparent material. Although a constituent material of the dial 3 is not particularly limited, examples thereof include various glass materials, various plastic materials, and the like. From the viewpoint of being lightweight and easy to process, plastic materials are preferred, among which polycarbonate is preferred. In the electronic timepiece 10, a light beam transmitted through the dial 3 reaches the solar panel 5, and electric power is generated by such a light beam.

It is preferable that the dial 3 functions to diffuse the light beam. Accordingly, visual recognition of, through the dial 3, the solar panel 5 which is a rear surface of the dial 3 can be prevented or suppressed. In general, in a wristwatch, it is preferable that the solar panel 5 is not visible from the outside as much as possible. Therefore, when visibility of the solar panel 5 is suppressed due to the function of diffusing the light beam, aesthetics of the electronic timepiece 10 are improved.

A method of causing the dial 3 to carry out the light diffusing function is not particularly limited. For example, examples of the method include a method of forming a diffusion layer containing a diffusing agent on at least one of the front side surface and the rear side surface of the dial 3, a method of installing a polarizing film, a method of forming a large number of minute evenness functioning as a prism, and the like.

Such a dial 3 has a barrel shape (a Tonneau shape) in a plan view. Further, the cover glass 12 and the solar panel 5 also have the similar barrel shape (the Tonneau shape). In the plan view, the electronic timepiece 10 is visually recognized in a direction in which the dial 3 can be visually recognized, which is a direction perpendicular to the dial 3.

As illustrated in FIGS. 2 to 4, the solar panel unit 4 includes the solar panel 5 and the support member 6.

The solar panel 5 functions to convert light energy into electric energy. The electric energy converted by the solar panel 5 is used for driving the movement 2, and the like.

As illustrated in FIG. 3, the solar panel 5 has the substrate 51, and a solar panel film 52 (a photoelectric conversion element) laminated on the substrate 51.

The substrate 51 functions to support the solar panel film 52. This substrate 51 is made of resin. Examples of the resin include various kinds of thermoplastic resin, thermosetting resin, and various kinds of curable resins such as photocurable resin.

In detail, the examples of the resin include polyolefin such as polyethylene, polypropylene, and an ethylene-propylene copolymer, polyvinyl chloride, polystyrene, polyamide, polyimide, polycarbonate, poly-(4-methylpentene-1), ionomer, acrylic resin, polymethyl methacrylate, acrylonitrile-butadiene-styrene copolymer (ABS resin), acrylonitrile-styrene copolymer (AS resin), butadiene-styrene copolymer, polyester such as polyethylene terephthalate (PET) and polybutylene terephthalate (PBT), polyether, polyether ketone (PEK), polyether ether ketone (PEEK), polyether imide, polyacetal (POM), polyphenylene oxide, polysulfone, polyethersulfone, polyphenylene sulfide, polyarylate, aromatic polyester (liquid crystal polymer), polytetrafluoroethylene, polyvinylidene fluoride, other fluorine-based resin, epoxy resin, phenol resin, urea resin, melamine resin, silicone resin, polyurethane, and the like, a copolymer, a blend, and a polymer alloy mainly containing them, and a combination of one or two or more of them.

Among them, it is preferable that the substrate 51 is mainly made of polyester. Accordingly, flexibility of the substrate 51 increases, and workability when the solar panel 5 and the support member 6 are bonded to each other increases.

The solar panel film 52 has, for example, a pin structure in which a p-type impurity and an n-type impurity are selectively introduced into a non-single-crystal silicon thin film and an i-type non-single-crystal silicon thin film having a low impurity concentration is included between a p-type non-single-crystal silicon thin film and an n-type non-single-crystal silicon thin film.

Further, the solar panel 5 has notches 53 formed by notching edge portions thereof toward a central side of the solar panel 5. The notches 53 are cut out over the entire area of the solar panel 5 in a thickness direction. In other words, the notches 53 can be referred to as laterally opened through-holes. The notches 53 will be described below in detail.

As illustrated in FIG. 3, an electrode 54, which will be described below, is formed in the solar panel 5. Electric power generated by the solar panel 5 is supplied to the secondary battery 233 through a conductive spring 9 connected to the electrode 54 and a not-illustrated wiring.

Two conductive springs 9 are provided. One conductive spring 9 is connected to a positive electrode (not illustrated) of the electrode 54, and the other conductive spring 9 is connected to a negative electrode (not illustrated) of the electrode 54.

Further, the solar panel 5 has a structure in which five solar cells are connected in series with each other. Connectors 55 connecting adjacent solar cells in series to each other are provided at an approximately central portion of the solar panel 5.

Further, the thickness of the entire solar panel 5 (a maximum thickness) is preferably equal to or more than 0.03 mm and equal to or less than 0.5 mm, and is more preferably equal to or more than 0.05 mm and equal to or less than 0.3 mm.

Such a solar panel 5 includes the entire movement 2 in the plan view. That is, the solar panel 5 is larger than the movement 2 in the plan view. Accordingly, an area of the solar panel 5, which receives an external light beam, increases, and generation efficiency of the solar panel 5 increases.

As illustrated in FIG. 2, the support member 6 (a dial reception ring) is disposed on the rear surface side of the dial 3, which is an outer periphery of the main plate 21. Further, as illustrated in FIG. 3, the support member 6 is configured with a frame-like member, and supports the solar panel 5 inside the frame. An outer shape of the support member 6 when viewed from a central axis O direction (when in plan view) corresponds to a barrel shape (a Tonneau shape).

Further, as illustrated in FIGS. 3 and 4, the support member 6 has stepped portions 61 at an inner peripheral portion (an inner peripheral side) thereof, and supports the solar panel 5 on upper surfaces of the stepped portions 61. As will be described below, the surfaces of the stepped portions 61 function as bonding surfaces 62 to which the solar panel 5 is bonded. The stepped portions 61 are portions that have dropped downward from an upper surface 60*a* of the support member 6.

The pair of stepped portions 61 are provided with respect to the central axis O of the support member 6, and are provided on 12 o'clock side and 6 o'clock side of the support member 6. Since the support member 6 has a barrel shape, the sufficiently large bonding surfaces 62 can be ensured as compared with a case where the stepped portions 61 are provided on 3 o'clock side and 9 o'clock side. Thus, bonding strength between the support member 6 and the solar panel 5 can be increased.

Further, the height of an upper surface of a raised portion 612 with respect to the position of a bottom surface 611 is preferably equal to or more than 0.03 mm and equal to or less than 0.5 mm, and is more preferably equal to or more than 0.05 mm and equal to or less than 0.3 mm. Accordingly, the solar panel 5 can be accommodated inside the stepped portions 61. That is, in a state in which the solar panel 5 is fixed to the support member 6, an upper surface of the solar panel 5 can be prevented from protruding above the upper surface 60*a* of the support member 6. When the upper surface of the solar panel 5 protrudes above the upper surface 60*a* of the support member 6, the solar panel 5 comes into contact with the rear surface of the dial, and thus appearance defects occur. However, these defects can be prevented. Further, the solar panel unit 4 can be thinned.

Further, as illustrated in FIGS. 3 and 4, a plurality of (two in the present embodiment) positioning pins 63 are provided on the upper surface 60*a* of the support member 6. The pair of positioning pins 63 are provided in a longitudinal direction through the central axis O of the support member 6. Each positioning pin 63 protrudes upward (toward the dial) from the upper surface 60*a* of the support member 6.

This positioning pin 63 is fitted in an insertion hole provided in the dial 3. Accordingly, the dial 3 and the support member 6 can be positioned. Further, the pair of positioning pins 63 are provided through the central axis O of the support member 6 in a longitudinal direction, so that the dial 3 and the support member 6 can be positioned more stably.

Further, a plurality of (three in the present embodiment) hook portions 64 are provided on a lower surface 60*b* of the support member 6. The hook portions 64 can be engaged with the edge portion of the main plate 21, and can fix the support member 6 and the main plate 21 to each other.

The hook portions 64 protrude downward from the lower surface 60*b*, and are disposed substantially at regular angular intervals around the central axis O of the support member 6. Further, a tip end portion (an end portion on a lower side) of each hook portion 64 has a claw portion 641 protruding from the central axis O of the support member 6. Each claw portion 641 can be engaged with the main plate 21, and thus can fix the support member 6 and the main plate 21 to each other.

The support member 6 is made of resin. When the support member 6 is made of a conductive material such as metal, if radio waves are received by an antenna, an eddy current occurs and reception sensitivity is lowered. The support member 6 is made of resin, so that the reception sensitivity can be prevented from being lowered. Examples of the resin include various kinds of thermoplastic resin, thermosetting resin, and various kinds of curable resins such as photocurable resin.

In detail, the examples of the resin include polyolefin such as polyethylene, polypropylene, and an ethylene-propylene copolymer, polyvinyl chloride, polystyrene, polyamide, polyimide, polycarbonate, poly-(4-methylpentene-1), ionomer, acrylic resin, polymethyl methacrylate, acrylonitrile-butadiene-styrene copolymer (ABS resin), acrylonitrile-styrene copolymer (AS resin), butadiene-styrene copolymer, polyester such as polyethylene terephthalate (PET) and polybutylene terephthalate (PBT), polyether, polyether ketone (PEK), polyether ether ketone (PEEK), polyether imide, polyacetal (POM), polyphenylene oxide, polysulfone, polyethersulfone, polyphenylene sulfide, polyarylate, aromatic polyester (liquid crystal polymer), polytetrafluoroethylene, polyvinylidene fluoride, other fluorine-based resin, epoxy resin, phenol resin, urea resin, melamine resin, silicone resin, polyurethane, and the like, a copolymer, a blend, and a polymer alloy mainly containing them, and a combination of one or two or more of them.

Among them, it is preferable that the support member 6 is mainly made of polycarbonate. Accordingly, sufficient strength of the support member 6 can be secured.

Here, as illustrated in FIG. 4, the bonding surface 62 and the rear surface of the solar panel 5 are fixed to each other through the adhesive layer 7 (a bonding layer).

The adhesive layer 7 is made of, for example, various hot melt adhesives (a polyester-based adhesive and a modified olefin adhesive), or the like in addition to an epoxy adhesive, an acrylic adhesive, a urethane adhesive, and a silicone adhesive. Further, a curable adhesive such as an ultraviolet (UV) curable adhesive and a thermosetting adhesive may be used.

Further, as described above, when the substrate 51 of the solar panel 5 is mainly made of polyester, and the support member 6 is made of polycarbonate, it is preferable that the adhesive layer 7 is made of epoxy adhesive. Accordingly, bonding strength between the solar panel 5 and the support member 6 can increase.

Further, the adhesive layer 7 can be formed by applying an adhesive by a dispenser or the like, and is particularly advantageous in a fine structure such as a timepiece.

Further, as described above, the support member 6 (a support member) has the stepped portions 61 on an inner peripheral side thereof, and the stepped portions 61 have the bonding surfaces 62 bonded to the solar panel 5 by the adhesive layer 7 (the bonding layer).

Accordingly, as compared to a case where the solar panel 5 is bonded to the upper surface 60*a* of the support member 6, the solar panel 5 can be fixed while coming into a middle of the support member 6 in the thickness direction. Thus, the thickness of the entire solar panel unit 4 can be prevented from being thickened.

Further, the area of the bonding surface 62 is preferably equal to or more than 5% and equal to or less than 50% of the area of the solar panel 5 in the plan view, and is more preferably equal to or more than 7% and equal to or less than 20% thereof. Accordingly, sufficient bonding strength can be secured, and the size of the solar panel unit 4 in the plan view can be prevented from excessively increasing.

Further, each of the stepped portions 61 has the bottom surface 611 and the raised portion 612 protruding from the bottom surface 611 in the thickness direction of the support member 6. The plurality of (five in the present embodiment) raised portions 612 are provided to extend along a circumferential direction of the support member 6. The bonding surfaces 62 are configured with the outer surfaces of the raised portions 612 and the bottom surfaces 611.

In the present embodiment, the adhesive layer 7 is provided on each of the raised portions 612. That is, the adhesive layer 7 (the bonding layer) is provided at five positions (a plurality of positions) along the circumferential direction of the support member 6. Accordingly, the bonding strength between the solar panel 5 and the support member 6 can further increase, and a bonding state can be maintained stably. Further, a space where the adhesive layer 7 is installed at a portion of the tonneau shape in the width direction can be omitted, and the width direction of the tonneau can be prevented from excessively increasing.

Further, stepped portions are formed between the bottom surfaces 611 and opposite sides of the raised portions 612 in the width direction. A space formed by the stepped portions functions as a relief portion which an excess portion of the adhesive layer 7 enters.

In this way, in the electronic timepiece 10, the bonding layer is the adhesive layer 7, and the space as the relief portion which the adhesive enters is formed on the bonding surface 62. Accordingly, an excess portion of the adhesive can be prevented from being unwillingly attached to the other portions. Further, since the adhesive layer 7 located in the space also contributes to the bonding between the solar panel 5 and the support member 6, bonding strength increases accordingly.

In the present embodiment, the relief portion is formed by the steps between the raised portions 612 and the bottom surfaces 611. However, the relief portion may be formed by separately providing a groove or the like.

Further, the solar panel unit 4 is assembled using a positioning jig 8 (a positioning portion) that positions the solar panel 5 and the support member 6. Accordingly, when the solar panel 5 and the support member 6 are assembled, the assembling operation can be easily performed. Hereinafter, this assembling operation will be described.

The support member 6 has through-holes 623 penetrating from the bottom surfaces 611 to the rear surface (a lower surface). The pair of through-holes 623 are provided with respect to the central axis O of the support member 6. Further, the through-holes 623 are formed on outer peripheral sides of the raised portions 612, that is, on distal sides from the raised portions 612 with respect to the central axis O of the support member 6 (see FIG. 3).

Positioning pins 812 of the positioning jig 8 are inserted into the through-holes 623 and the above-described notches 53 formed at the edge portions of the solar panel 5, so that the support member 6 and the solar panel 5 are fixed to each other.

The positioning jig 8 has a plate-like body 811 and the positioning pins 812 protruding from the body 811. The positioning pins 812 are portions that are collectively inserted into the through-holes 623 and the notches 53. Accordingly, a state in which the solar panel 5 and the support member 6 are positioned can be maintained.

Such positioning pins 812 are used, for example, as follows. Further, the through-holes 623 of the support member 6 are inserted into the positioning pins 812. At this time, tip end portions of the positioning pins 812 are in a state of protruding from the surface of the support member 6. Thus, the adhesive is applied to the raised portions 612 of the support member 6, so that the adhesive layer 7 is formed. In this state, the solar panel 5 is disposed such that the notches 53 of the solar panel 5 follow the positioning pins 812, so that the solar panel 5 and the support member 6 are positioned. In detail, the solar panel 5 is disposed such that edge portions of the notches 53 of the solar panel 5 and edge portions of the through-holes 623 of the support member 6 overlap each other. Thus, the rear surface of the solar panel 5 and the support member 6 are bonded to each other. In this case, a load is applied to positions corresponding to the raised portions 612 (the adhesive layer 7) from the surface side of the solar panel 5, so that the rear surface of the solar panel 5 and the support member 6 are certainly bonded to each other. For example, weights are placed at positions corresponding to the raised portions 612 from the surface side of the solar panel 5. Thereafter, the support member 6 attached to the positioning pins 812 and the solar panel 5 are installed in a thermostatic bath and the adhesive is thermally hardened and dried, so that the solar panel 5 and the support member 6 are certainly fixed to each other. Finally, the solar panel 5, the support member 6, and the positioning pins 812 are withdrawn from the thermostatic bath, and the solar panel 5 and the support member 6 fixed to each other are removed from the positioning pins 812. In this way, the solar panel unit 4 is formed.

In this way, the positioning portion has the notches 53 (solar panel side positioning holes) provided in the solar panel 5 and the through-holes 623 (support member side positioning holes) provided in the support member 6. Accordingly, the solar panel 5 and the support member 6 can be positioned. In particular, as compared to a configuration in which the support member 6 has a guide pin, the guide pin is omitted, which contributes to thinning.

In the present embodiment, the notches that are through-holes opened on a lateral side as the solar panel side positioning holes are used. However, the notches may have a shape that is not opened on the lateral side.

Further, the adhesive layer 7 (the bonding layer) is provided eccentrically from the center axis O (a center) of the support member 6, in the plan view of the solar panel 5. The adhesive layer 7 (the bonding layer) can, for example, be provided at a position corresponding to an edge portion of the solar panel 5. Accordingly, bending of the edge portion of the solar panel 5 can be prevented from occurring. Further, in the present embodiment, the conductive springs 9 are provided at a vicinity of the edge portion of the solar panel 5, and the conductive springs 9 urge the vicinity of the edge portion of the solar panel 5. As a distance between the urged portion and the bonded portion becomes larger, the bending of the solar panel becomes larger, and the dial 3 and the solar panel 5 come into contact with each other. In the present embodiment, the contact between the dial 3 and the solar panel 5 can be prevented.

Further, as described above, the solar panel 5 has the connectors 55, and the connectors 55 are provided at positions that are different from a position of the bonding layer, in the plan view of the solar panel 5. In detail, the connectors 55 are provided at a central portion of the solar panel 5. As described above, a load is applied to positions corresponding to the raised portions 612 (the adhesive layer 7) from the surface side of the solar panel 5, so that the solar panel 5 and the support member 6 are certainly bonded to each other. In this case, when the load is applied to the connectors 55, the connectors 55 may be damaged. The connectors are provided at the central portion of the solar panel 5, and the adhesive layer 7 and the connectors 55 are separated from each other, so that the connectors can be prevented from being damaged.

As described above, according to the invention, the solar panel unit 4 can be thinned, which contributes to thinning of the entire electronic timepiece 10.

The solar panel 5 and the dial 3 may be in close contact with each other or may be separated from each other. In the separation case, a separation distance therebetween (average separation distance) is preferably equal to or more than 0.01 mm and equal to or less than 0.3 mm, and is more preferably equal to or more than 0.01 mm and equal to or less than 0.1 mm. Accordingly, the solar panel 5 can be deformed, a damage caused by stress concentration can be prevented, and the solar panel unit 4 can be thinned.

Further, when the solar panel unit 4 is manufactured, the solar panel 5 is accommodated in the stepped portions 61 of the support member 6. Thereafter, the adhesive may be poured between the solar panel 5 and the support member 6. In this case, for example, the adhesive is supplied through the notches 53 and the through-holes 623, the adhesive layer 7 can be formed by the capillary phenomenon. Further, it is unnecessary to separately provide a new adhesive support port, and a configuration of the solar panel unit 4 can be prevented from being complicated.

Although the adhesive layer has been described as an example of the bonding layer in the present embodiment, the invention is not limited thereto. A pressure sensitive adhesive layer made of pressure sensitive adhesive (a pressure sensitive adhesive composition) may be used as the bonding layer. Any one of rubber-based pressure sensitive adhesive, acrylic pressure sensitive adhesive, silicone pressure sensitive adhesive, or the like may be used as the pressure sensitive adhesive (the pressure sensitive adhesive composition).

Although the solar panel unit, the solar panel-equipped movement, and the timepiece according to the invention have been described above with reference to the illustrated embodiment, the invention is not limited thereto. Further, each unit constituting the solar panel unit, the solar panel-equipped movement, and the timepiece can be replaced with a predetermined configuration that can exhibit the same function. Further, a predetermined composition (process) may be added.

Further, in the present embodiment, the example of the tonneau shape is illustrated as an example of the electronic timepiece. However, the invention can be applied to the electronic timepiece having the other shapes such as a round shape and a square shape.

Further, in the present embodiment, a wristwatch has been described as the example of the electronic timepiece. However, the invention is not limited, and can be applied to a clock, a pendant type clock, a pocket watch, and the like.

Further, although a radio wave timepiece that receives a long radio wave has been described, the invention can be applied to a radio wave timepiece having a solar battery that receives a radio wave such as a GPS radio wave, Bluetooth (a registered trademark), Wi-Fi, and LPWA.

Further, the solar panel unit is not limited to the above-described electronic timepiece. For example, the invention can be applied to a solar panel-equipped wrist device having a function of measuring the number of steps, a pulse, a blood pressure, an atmospheric pressure, an altitude, or the like.

The entire disclosure of Japanese Patent Application No. 2018-16812, filed Feb. 1, 2018 is expressly incorporated by reference herein.

What is claimed is:

1. A movement comprising:

a solar panel that has a substrate made of resin and converts light energy into electric energy;

a support member that is made of resin, has a frame shape, and supports the substrate by being bonded thereto using a bonding layer;

a driving mechanism that is driven with the electric energy converted by the solar panel; and a main plate to which the driving mechanism is attached and the support member is fixed, wherein the support member has a stepped portion located on an inner peripheral of the support member, the support member and the substrate are bonded to each other in the stepped portion, the bonding layer is an adhesive, and the stepped portion has a raised portion provided with the bonding layer and a relief portion which the adhesive enters.

2. The movement according to claim 1, further comprising;

another raised portion is provided in the stepped portion.

3. The movement according to claim 1, wherein the bonding layer is provided at an edge portion of the solar panel, in a plan view seen in a direction that is perpendicular to the solar panel.

4. The movement according to claim 1, wherein the solar panel has a plurality of solar cells and connectors that connect the adjacent solar cells in series to each other, and wherein the connectors are provided at positions that are different from a position of the bonding layer, in a plan view seen in a direction that is perpendicular to the solar panel.

5. The movement according to claim 1, wherein the solar panel and the support member each have a positioning portion that positions the solar panel and the support member.

6. The movement according to claim 5, wherein the positioning portion includes a positioning hole provided in the solar panel and a positioning hole provided in the support member.

7. A timepiece comprising:

a solar panel that has a substrate made of resin and converts light energy into electric energy;

a support member that is made of resin, has a frame shape, and supports the substrate through bonding through a bonding layer;

a driving mechanism that is driven with the electric energy converted by the solar panel;

a main plate to which the driving mechanism is attached and the support member is fixed; and a case that accommodates the solar panel, the support member, the driving mechanism, and the main plate, wherein the support member has a stepped portion located on an inner peripheral of the support member, the support member and the substrate are bonded to each other in the stepped portion, the bonding layer is an adhesive, and the stepped portion has a raised portion provided with the bonding layer and a relief portion which the adhesive enters.

8. A movement comprising:

a solar panel that has a substrate made of resin and converts light energy into electric energy;

a support member that is made of resin, has a frame shape, and supports the substrate by being bonded thereto using a bonding layer;

a driving mechanism that is driven with the electric energy converted by the solar panel; and a main plate to which the driving mechanism is attached and the support member is fixed, wherein the support member has a stepped portion located on an inner peripheral of the support member, the solar panel and the support member each have a positioning portion that positions the solar panel and the support member, and the positioning portion includes a positioning hole provided in the solar panel and a positioning hole provided in the support member.

9. A timepiece comprising:

a solar panel that has a substrate made of resin and converts light energy into electric energy;

a support member that is made of resin, has a frame shape, and supports the substrate through bonding through a bonding layer;

a driving mechanism that is driven with the electric energy converted by the solar panel;

a main plate to which the driving mechanism is attached and the support member is fixed; and a case that accommodates the solar panel, the support member, the driving mechanism, and the main plate, wherein the support member has a stepped portion located on an inner peripheral of the support member, the solar panel and the support member each have a positioning portion that positions the solar panel and the support member, and the positioning portion includes a positioning hole provided in the solar panel and a positioning hole provided in the support member.

* * * * *